US007817308B2

(12) United States Patent
Yamazaki

(10) Patent No.: US 7,817,308 B2
(45) Date of Patent: Oct. 19, 2010

(54) IMAGE FORMING APPARATUS, CONTROL METHOD FOR IMAGE FORMING APPARATUS AND STORAGE MEDIUM STORING CONTROL PROGRAM

(75) Inventor: Hiroyuki Yamazaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 717 days.

(21) Appl. No.: 11/737,845

(22) Filed: Apr. 20, 2007

(65) Prior Publication Data

US 2007/0286623 A1 Dec. 13, 2007

(30) Foreign Application Priority Data

May 10, 2006 (JP) ..... 2006-131222

(51) Int. Cl.
*G03G 15/043* (2006.01)

(52) U.S. Cl. ..... 358/3.06; 358/1.9; 399/51

(58) Field of Classification Search ..... 358/1.9, 358/3.06; 399/51
See application file for complete search history.

(56) References Cited

U.S. PATENT DOCUMENTS 6,320,675 B1 11/2001 Sakaki et al.
6,384,935 B1 * 5/2002 Yamazaki ..... 358/1.9
6,411,402 B1 6/2002 Sakaki et al.
6,445,467 B1 9/2002 Sakaki et al.
6,512,836 B1 * 1/2003 Xie et al. ..... 382/100
6,721,067 B2 4/2004 Sakaki et al.
6,822,761 B2 11/2004 Sakaki et al.
7,277,585 B2 * 10/2007 Yagishita et al. ..... 382/232
2005/0135856 A1 * 6/2005 Uchida et al. ..... 399/411

FOREIGN PATENT DOCUMENTS

JP 2002-202650 7/2002

* cited by examiner

*Primary Examiner*—Benny Q Tieu
*Assistant Examiner*—Qian Yang
(74) *Attorney, Agent, or Firm*—Fitzpatrick, Cella, Harper & Scinto

(57) ABSTRACT

The image forming apparatus for forming an image on a recording sheet based on an input image signal includes a halftone processor that applies a halftone process to an input image signal with a predetermined halftone processing period, and an add-on processor that attaches, to the image signal subjected to the halftone process, an add-on signal with an add-on period which is determined according to the halftone process period. The invention enables to suppress an image deterioration and to improve detection accuracy of the add-on signal.

8 Claims, 12 Drawing Sheets

| Tx' | Dx | LCM |
|---|---|---|
| 22 | 4 | 44 |
| 23 | 4 | 92 |
| 24 | 4 | 24 |
| 25 | 4 | 100 |
| 26 | 4 | 52 |

| Ty' | Dy | LCM |
|---|---|---|
| 22 | 6 | 66 |
| 23 | 6 | 138 |
| 24 | 6 | 24 |
| 25 | 6 | 150 |
| 26 | 6 | 78 |

| Tx' | Dx | LCM |
|---|---|---|
| 22 | 10 | 110 |
| 23 | 10 | 230 |
| 24 | 10 | 120 |
| 25 | 10 | 50 |
| 26 | 10 | 130 |

| Ty' | Dy | LCM |
|---|---|---|
| 22 | 10 | 110 |
| 23 | 10 | 230 |
| 24 | 10 | 120 |
| 25 | 10 | 50 |
| 26 | 10 | 130 |

FIG. 13A

| Tx' | Dx | LCM |
|---|---|---|
| 22 | 4 | 44 |
| 23 | 4 | 92 |
| 24 | 4 | 24 |
| 25 | 4 | 100 |
| 26 | 4 | 52 |

| Ty' | Dy | LCM |
|---|---|---|
| 22 | 6 | 66 |
| 23 | 6 | 138 |
| 24 | 6 | 24 |
| 25 | 6 | 150 |
| 26 | 6 | 78 |

FIG. 13B

| Tx' | Dx | LCM |
|---|---|---|
| 22 | 10 | 110 |
| 23 | 10 | 230 |
| 24 | 10 | 120 |
| 25 | 10 | 50 |
| 26 | 10 | 130 |

| Ty' | Dy | LCM |
|---|---|---|
| 22 | 10 | 110 |
| 23 | 10 | 230 |
| 24 | 10 | 120 |
| 25 | 10 | 50 |
| 26 | 10 | 130 |

FIG. 14A

| Rx' | Dx | LCM |
|---|---|---|
| 122 | 4 | 244 |
| 123 | 4 | 492 |
| 124 | 4 | 124 |
| 125 | 4 | 500 |
| 126 | 4 | 252 |

| Ry' | Dy | LCM |
|---|---|---|
| 122 | 6 | 366 |
| 123 | 6 | 246 |
| 124 | 6 | 372 |
| 125 | 6 | 750 |
| 126 | 6 | 126 |

FIG. 14B

| Rx' | Dx | LCM |
|---|---|---|
| 122 | 10 | 610 |
| 123 | 10 | 1230 |
| 124 | 10 | 620 |
| 125 | 10 | 250 |
| 126 | 10 | 630 |

| Ry' | Dy | LCM |
|---|---|---|
| 122 | 10 | 610 |
| 123 | 10 | 1230 |
| 124 | 10 | 620 |
| 125 | 10 | 250 |
| 126 | 10 | 630 |

FIG. 15A

| | | | | |
|---|---|---|---|---|
| A | B | C | D | A |
| E | F | G | H | E |
| I | J | K | L | I |
| C | D | A | B | C |

FIG. 15B

| | | | | |
|---|---|---|---|---|
| G | H | E | F | G |
| K | L | I | J | K |
| A | B | C | D | A |
| E | F | G | H | E |

IMAGE FORMING APPARATUS, CONTROL METHOD FOR IMAGE FORMING APPARATUS AND STORAGE MEDIUM STORING CONTROL PROGRAM

BACKGROUND OF THE INVENTION

1. Field of the Invention

The present invention relates to an image forming apparatus such as a printer or a copying apparatus, a control method therefor and a storage medium storing a control program. More particularly it relates to an image forming apparatus for providing an image signal with predetermined add-on signals, a control method and a control program therefor.

2. Description of the Related Art

Image forming apparatuses such as printers and copying apparatuses are recently showing remarkable progress in performance, and are becoming capable of forming a high-quality image. In this situation, it is now becoming possible to form images equivalent to bank bills, banknotes and valuable securities, and the problems of forging bank bills or banknotes and infringement on copyrights may increase hereafter.

As a measure for suppressing such problems, for example, a following method is known. It is a signal add-on method, in which, in a color image formed by an image forming apparatus, attached are add-on signals representing tracing information such as a serial number relating to such image forming apparatus, in a state not easily discernible to human eyes (for example cf. Japanese Patent Application Laid-Open No. 2002-202650). This method allows, when a forged bank bill or the like is found, to specify the image forming apparatus that has executed the forging, from the add-on signals attached to the forged bank bill.

Normally, such add-on signals are attached to the entire image. Also, for example, in the case of adding the add-on signals to a color image constituted of yellow, magenta, cyan and black planes, the add-on signals are added only to the yellow plane having low visibility, in order to make the signal less discernible to human eyes.

By attaching the add-on signals to the color image as described above, when an image of which formation is inhibited or a copied image of which copying is inhibited is found, it is possible to extract the add-on signals from such images to reproduce the tracing information, thereby specifying the image forming apparatus that has formed these images.

The add-on signals are attached to all the output images, regardless of whether image formation or copying is inhibited or not. On the other hand, in the image forming apparatus, an intermediate tone process (halftone process) is executed to form screen dots according to the input image data.

In such conventional examples, when the periodicity of the formed screen dots and the attaching periodicity of the add-on signals are in a mutually multiple relationship, the positional relationship between the screen dots and the add-on signals becomes fixed. Therefore, when the screen dots are superposed with the add-on signals, all the add-on signals overlap with the screen dots, whereby the screen dots and the add-on signal become difficult to distinguish and the detection accuracy of the add-on signals is significantly deteriorated. On the other hand, when the screen dot and the add-on signal are adjacent to each other, all the add-on signals are linked with the screen dots and become easily noticeable, whereby the image quality is significantly deteriorated. Particularly a case where the near-by screen dots are linked by the add-on signal, a larger dot is thereby formed whereby the add-on signal becomes more easily noticeable and the image quality is significantly deteriorated.

Also, even when the periodicity of the formed screen dots and the attaching periodicity of the add-on signals are not in a mutually multiple relationship, in the case where the periodicity of the formed screen dots and the attaching periodicity of the add-on signals have a small least common multiple, a proportion of the screen dots and the add-on signals that assume a same positional relationship increases within a given area, thereby leading to the problems described above.

SUMMARY OF THE INVENTION

The present invention has been made in consideration of such situation, and an object thereof is to provide an image forming apparatus capable of improving the detection accuracy of add-on signals while suppressing the deterioration in the image quality, and a control method and a control program therefor.

Another object of the present invention is to provide an image forming apparatus capable of improving the detection accuracy of add-on signals while suppressing the deterioration in the image quality, and a control method and a control program therefor.

A further object of the present invention is to provide an image forming apparatus, including a halftone processor that applies a halftone process to an input image signal with a predetermined halftone process period, an add-on processor that adds, to that image signal subjected to the halftone process, add-on signals with an add-on period which is determined based on the halftone process period, and an image forming unit that forms an image on a recording medium, based on an output of the add-on processor.

A further object of the present invention is to provide a control method for an image forming apparatus, including an intermediate process step of applying a halftone process to an input image signal with a predetermined halftone process period, an add-on process step of adding, to that image signal subjected to the halftone process in the halftone process, add-on signals with an add-on period which is determined based on the halftone process period, and an image forming step of forming an image on a recording medium, based on the image signal to which the add-on signals are added.

A further object of the present invention is to provide a storage medium storing a control program for controlling an image forming apparatus for forming an image on a recording medium based on an input image signal, the storage medium storing a program code of an intermediate process step of applying a halftone process to the image signal with a predetermined halftone process period, and a program code of an add-on process step of adding, to that image signal subjected to the halftone process in the intermediate process step, add-on signals with an add-on period which is determined based on the halftone process period.

A still further object of the present invention will become apparent from the following description of exemplary embodiments with reference to the attached drawings.

BRIEF DESCRIPTION OF THE DRAWINGS

FIGS. 13A and 13B are views describing a calculation method for add-on period in the exemplary embodiment 2.

FIGS. 14A and 14B are views describing a calculation method for a period of the add-on pattern in the exemplary embodiment 2.

FIGS. 15A and 15B are views illustrating a positional relationship between add-on signals and screen dots for each add-on pattern in the exemplary embodiment 2.

DESCRIPTION OF THE EMBODIMENTS

An exemplary embodiment of the present invention will be described in the following examples.

However, dimension, material, shape, relative positioning and the like of components described in the examples are not to be construed to limit the scope of the invention thereto, unless specified otherwise.

EXAMPLE 1

Figure 1:
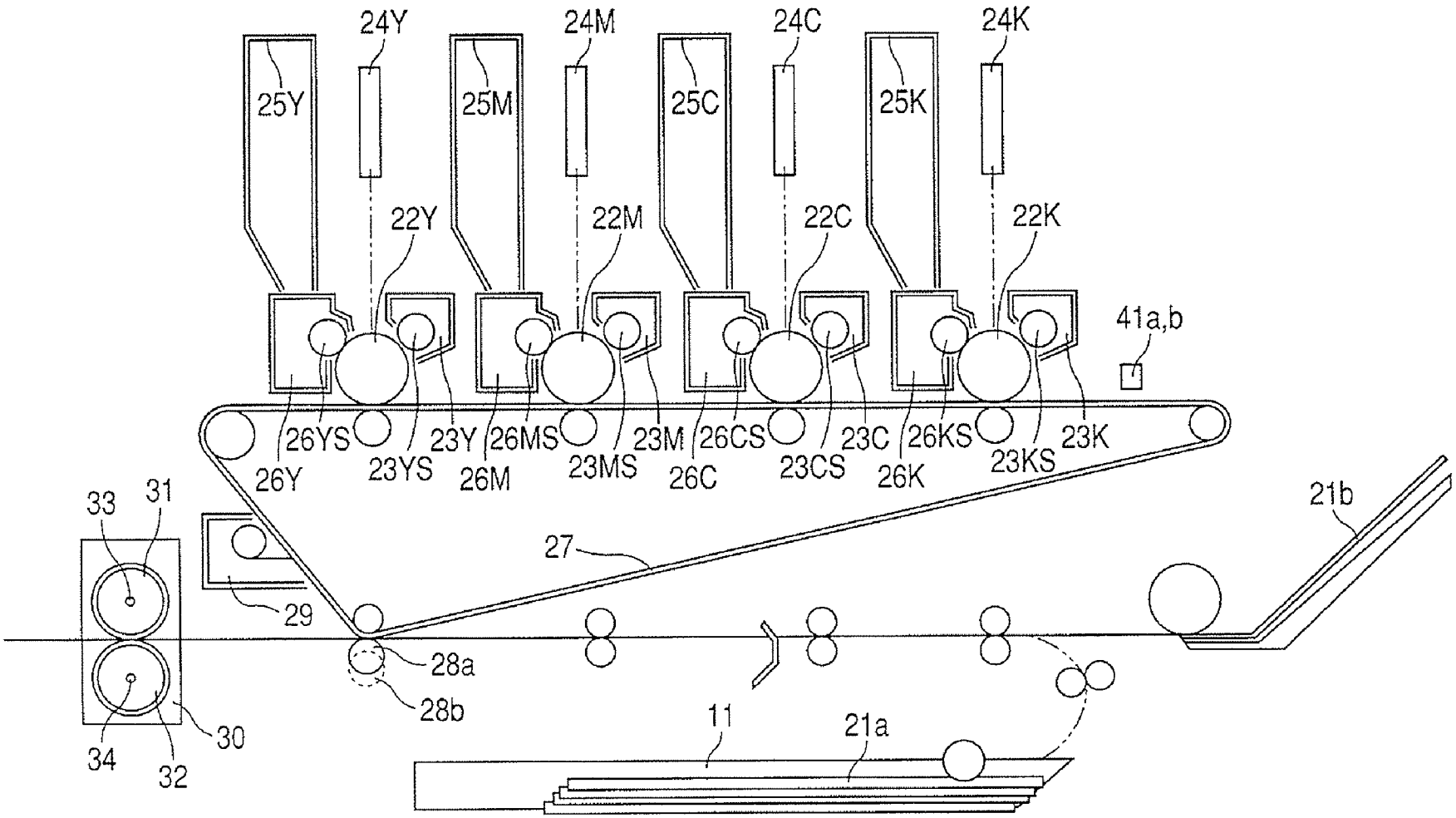
FIG. 1 is a schematic cross-sectional view of a color image forming apparatus of an exemplary embodiment 1.

FIG. 1 illustrates an example of a color image forming apparatus utilizing an electro-photographic process of the present example. FIG. 1 is a schematic cross-sectional view of a color image forming apparatus of tandem type, utilizing an intermediate transfer belt 27 as an intermediate transfer member.

Now, functions of an image forming unit, in the color image forming apparatus of the present example, will be described.

At first, an electrostatic latent image is formed on a photosensitive member, by an exposing light turned on according to an exposure time, converted from input image data. Then the electrostatic latent image is developed to form a monochromatic toner image, and such monochromatic toner images are superposed to form a multi-color toner image. Subsequently, the formed multi-color toner image is transferred onto a recording sheet 11 as a recording medium, and the multi-color toner image is fixed on the recording sheet 11.

The image forming unit includes sheet feeding units 21*a*, 21*b*, photosensitive drums 22Y-22K, injection chargers 23Y-23K, toner cartridges 25Y-25K, developing devices 26Y-26K, an intermediate transfer belt 27, a transfer roller 28 and a fixing unit 30.

The photosensitive drums 22Y, 22M, 22C, 22K as image bearing members are respectively provided in stations, which are juxtaposed corresponding to developing colors of yellow (Y), magenta (M), cyan (C) and black (K). Each of the photosensitive drums 22Y-22K is formed by coating an organic photoconductive layer on an external periphery of an aluminum cylinder, and is rotated by a driving power from an unillustrated drive motor. The drive motor rotates the photosensitive drums 22Y-22K counterclockwise according to the image forming operation.

Injection chargers 23Y, 23M, 23C, 23K as primary charging units are respectively provided in the stations, and uniformly charge the surfaces of the photosensitive drums 22Y-22K of yellow (Y), magenta (M), cyan (C) and black (K). The injection chargers 23Y-23K are provided with sleeves 23YS, 23MS, 23CS, 23KS.

Exposing lights, based on input image data, from scanner units 24Y, 24M, 24C, 24K as exposure units are supplied to the photosensitive drums 22Y-22K whereby the surfaces of the photosensitive drums 22Y-22K are selectively exposed. Thus, electrostatic latent images, based on the image data, are formed on the surfaces of the photosensitive drums 22Y-22K.

Developers 26Y, 26M, 26C, 26K as developing units are respectively provided in the stations. The developing units 26Y-26K develop, utilizing toners of yellow (Y), magenta (M), cyan (C) and black (K), the electrostatic latent images formed on the photosensitive drums 22Y-22K as monochromatic toner images. The developing units 26Y-26K are provided with toner cartridges 25Y, 25M, 25C, 25K for supplying the developing units 26Y-26K with the toners of respective colors. Also the developing units 26Y-26K are respectively provided with sleeves 26YS, 26MS, 26CS, 26KS. The developing units 26Y-26K are detachably attached to the color image forming apparatus.

The intermediate transfer belt 27 as an intermediate transfer member is in contact with the photosensitive drums 22Y-22K, and, at the image formation, is rotated clockwise along the rotation of the photosensitive drums 22Y-22K. The monochromatic toner images formed on the photosensitive drums 22Y-22K are transferred in superposed manner on the intermediate transfer belt 27, thereby forming a multi-color toner image.

Subsequently the transfer roller 28 as transfer unit comes into contact with the intermediate transfer belt 27 to convey a recording sheet 11 conveyed from the sheet feeding units 21*a*, 21*b*, thereby transferring the multi-color toner image from the intermediate transfer belt 27 onto the recording sheet 11. The transfer roller 28 is movable between a contact position (position 28*a*) with the intermediate transfer belt 27 and a separate position (position 28*b*), and is in the position 28*a* contacted with the recording sheet 11 while the multi-color toner image is transferred onto the recording sheet 11 but is separated to the position 28*b* after the image formation.

The fixing unit 30 serves as a fixing means to fuse and fix the multi-color toner image transferred onto the recording sheet 11, while the recording sheet 11 is conveyed. The fixing unit 30 includes a fixing roller 31 for heating the recording sheet 11, and a pressure roller 32 for pressurizing the recording sheet 11 to the fixing roller 31. The fixing roller 31 and the pressure roller 32 are constructed in hollow shapes, and respectively incorporate heaters 33, 34 therein. The recording sheet 11 bearing the multi-color toner image is conveyed by the fixing roller 31 and the pressure roller 32, and is given heat and pressure, whereby the toner is fixed onto the surface of the recording sheet 11.

The recording sheet 11 after the fixation of the multi-color toner image is thereafter discharged by unillustrated discharge rollers onto an unillustrated discharge tray, whereby the image forming operation is terminated.

A cleaner 29 serves as a cleaning unit to clean the toner remaining on the intermediate transfer belt 27. Waste toner, remaining after the transfer of the four-colored toner image from the intermediate transfer belt 27 onto the recording sheet 11, is stored in a cleaner container of the cleaner 29.

Figure 2:
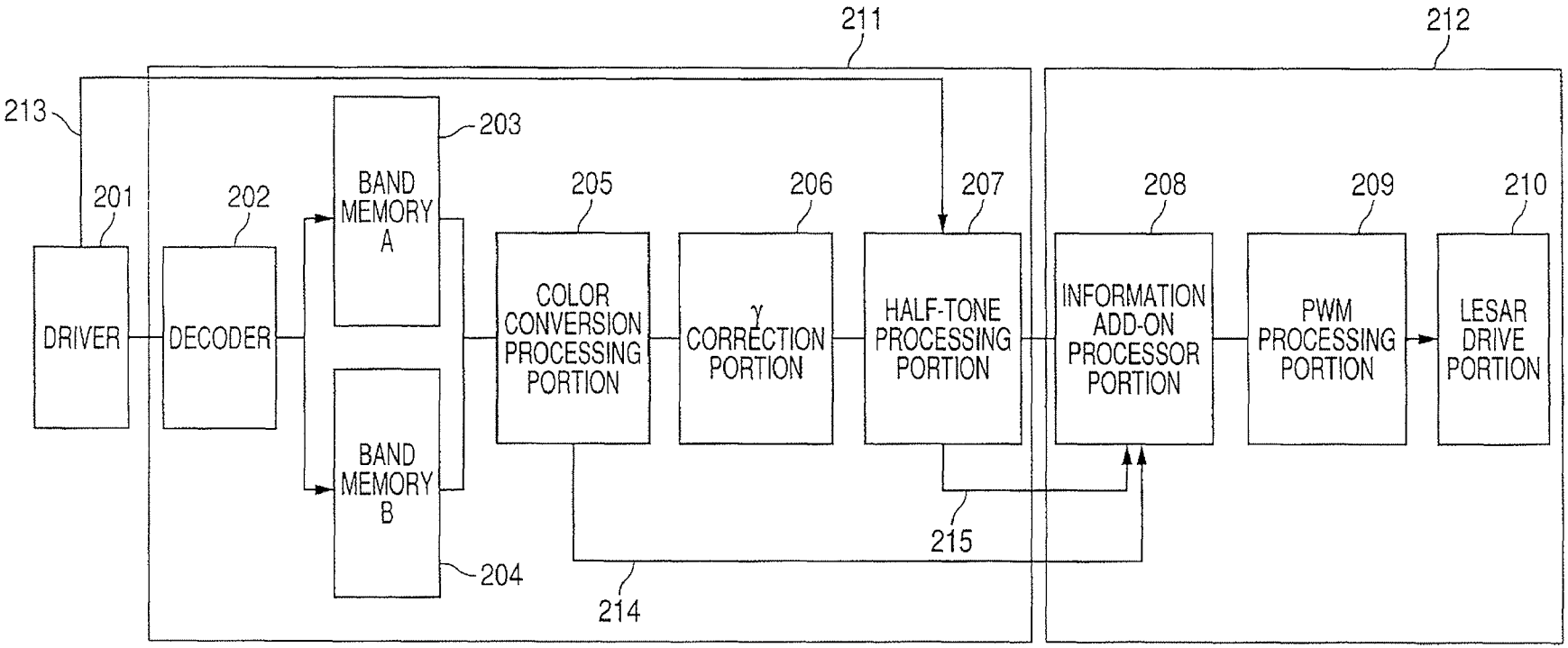
FIG. 2 is a block diagram illustrating a signal processing structure in the exemplary embodiment 1.

In the following, a structure for signal process in the present example will be described with reference to FIG. 2. FIG. 2 is a block diagram, illustrating a signal processing structure in the color image forming apparatus of the present example.

When a print command is issued for example from an unillustrated host computer, a page description language is emitted from the driver 201 on the host computer and supplied to a controller 211 in the color image forming apparatus. In case of an output of a bit map image, bit map data are contained in the page description language. The example assumes a structure, in which the print command is generated from the host computer, but the color image forming apparatus may have such a structure including an unillustrated image reading unit and an operation unit, in which the print command is issued from the operation unit and the image information is transmitted from the image reading unit.

At a printing operation, an attribute of the image to be printed by the driver 201 is determined, for example by a user designation of an image attribute such as a document image, a graphic image or a photographic image, or by an automatic discrimination for example by an application, and attribute information 213 is supplied to a halftone processing portion 207 as halftone process means.

The controller 211 includes a decoder 202, a band memory A 203, a band memory B 204, a color conversion processing portion 205, a γ-correction portion 206, and a halftone processing portion 207. The input page description language is interpreted by the decoder 202, and is converted into RGB image data of 8 bits each. The RGB image data are supplied to a band memory. The band memory is formed by a band memory A 203 and a band memory B 204, each capable of storing image data of several lines.

At first an initial image area of a predetermined number of lines is developed in the band memory A 203, and, while a next image area of a predetermined number of lines is developed in the band memory B 204, the band memory A 203 outputs the RGB image data. Thereafter, while a next image area of a predetermined number of lines is developed in the band memory A 203, the band memory B 204 outputs the RGB image data. In this manner, the two band memories alternately execute development and output of the image data.

The RGB image data output from the band memory A 203 and the band memory B 204 are input in parallel manner into the color conversion processing portion 205. The RGB image data input into the color conversion processing portion 205 is subjected to a predetermined color conversion process and an UCR process, and thus converted into image signals of yellow (Y), magenta (M), cyan (C) and black (K). The color image forming apparatus of the present example forms, as described above, each image of Y, M, C and K in succession. Therefore, the color conversion processing portion 205 outputs the image signals frame-sequentially with time differences, namely in the order of data of a Y frame, data of an M frame, data of a C frame and data of a K frame. Also the color conversion processing portion 205 sends a color designation signal 214, informing the currently output color, to an engine 212.

The image signal of each color, output from the color conversion processing portion 205, is corrected by the γ-correction portion 206 so as to obtain an optimum output density curve, and is subjected to a halftone process for example by a systematic dither process in the halftone processing portion 207. The halftone processing portion 207 transmits halftone information 215 to be described later to the engine 212.

The engine 212 includes, as signal add-on units, an information add-on processor portion 208, a PWM processing portion 209, and a laser drive portion 210. The image signal, subjected to the halftone process in the halftone processing portion 207, is subjected to an add-on of tracing information in the information add-on processor portion 208, further subjected to a pulse width modulation for D/A conversion in the PWM processing portion 209, and supplied to the laser drive portion 210, thus printed on the recording sheet 11.

In the following, there will be described the halftone process of the present example executed in the halftone processing portion 207.

The halftone processing portion 207 incorporates two dither tables of dither A and dither B. The dither A is a dither for a document image or a graphic image, and the dither B is a dither for a photographic image. Based on the input attribute information 213, the halftone processing portion 207 selects the dither A when the attribute information 213 indicates a document or graphic image, or the dither B when the attribute information 213 indicates a photographic image, and executes a halftone process utilizing the selected dither table.

Figure 3A:
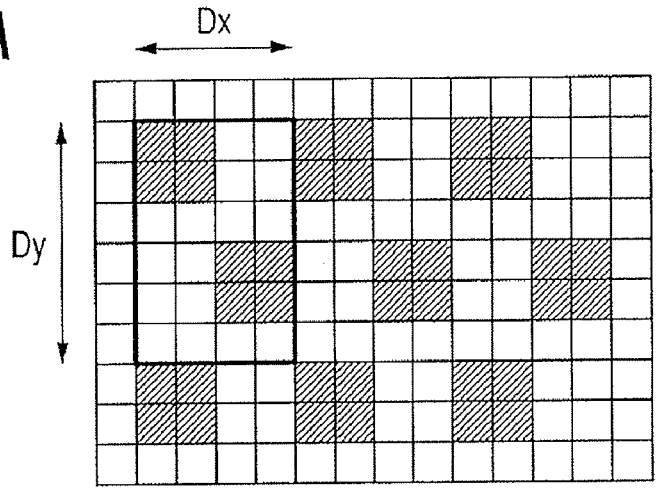
FIGS. 3A and 3B are views illustrating a halftone process in the exemplary embodiment 1.
Figure 3B:
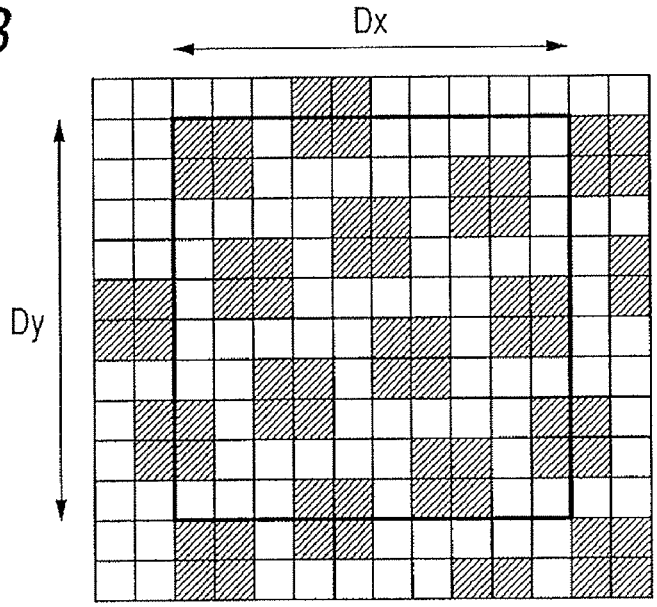

FIGS. 3A and 3B illustrates screen dot states in case of a halftone process with the dithers A and B on the input data. In FIGS. 3A and 3B, each square represents a pixel of the image forming apparatus, and a screen dot is formed in a hatched portion.

FIGS. 3A and 3B respectively illustrate the screen dot states in case of utilizing the dither A and the dither B. A rectangle indicated by a thick line indicates a minimum repeating rectangle of dither in the main and sub scanning directions, and the sizes of the minimum rectangle of the dither in the main and sub scanning directions are represented by Dx and Dy.

Now there will be described an add-on method of an add-on signal, constituting tracing information of the present example.

The add-on of the tracing information in the information add-on processor portion 208 is executed by an operation on the yellow pixel data. More specifically, a pattern of add-on signals is arranged according to a predetermined rule on the yellow pixel data.

Figure 4:
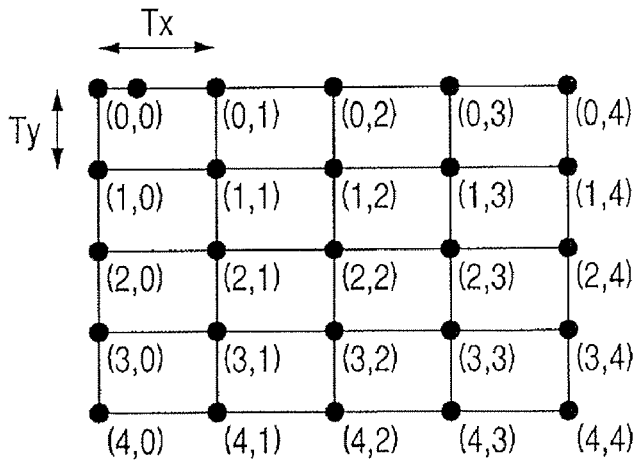
FIG. 4 is a view illustrating an add-on pattern in the exemplary embodiment 1.

FIG. 4 illustrates a basic add-on pattern of the add-on signal on the image.

In FIG. 4, positions indicated by black circles (0, 0)-(4, 4) are called add-on positions. The add-on positions are arranged with a pitch of Tx in the X-direction and a pitch of Ty in the Y-direction. Such pitch is called an add-on period. Each add-on position indicates 1-bit information, and the add-on signal is attached when the bit has a value 1, while the add-on signal is not attached when the bit has a value 0. Also a position (0, 0) indicates a start position of add-on pattern, and two add-on signals are attached with a predetermined distance. Therefore, the entire add-on pattern can represent 24-bit information. The add-on pattern illustrated in FIG. 4 is repeated over the entire image.

Figures 5, 6A, 6B:
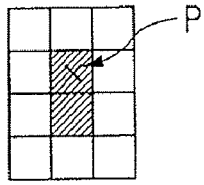
FIG. 5 is a view illustrating an add-on signal in the exemplary embodiment 1.
FIGS. 6A and 6B are views describing a calculation method for add-on period in the exemplary embodiment 1.

Each add-on signal is formed, as illustrated in FIG. 5, by turning on two pixel dots in the yellow image data, starting from a pixel in a position (P in FIG. 5) corresponding to the add-on position. The hatched area indicates pixels in which yellow is turned on, and the white area indicates surrounding pixels.

The add-on periods Tx, Ty have predetermined reference values which are respectively indicated by Sx, Sy. Also the add-on periods have a predetermined tolerable (range) margin ±α with respect to the reference values. Therefore Tx and Ty respectively have tolerable ranges from Sx−α to Sx+α, and from Sy−α to Sy+α.

In the present example, in the dither table selected by the halftone process portion 207, LCMs are calculated for the values of Dx, Dy and Tx'=Sx−α to Sx+α, and Ty'=Sy−α to Sy+α, and Tx' and Ty' giving maximum LCMs are respectively represented by Tx and Ty.

As a specific example, the calculation according to the dither A illustrated in FIG. 3A for Sx=24, Sy=24 and α=2 provides Dx=4 and Dy=6, thus giving least common multiples (LCMs) as illustrated in FIG. 6A, among which a largest LCM is selected. For the main scanning direction, Tx'=25 provides a largest LCM of 100 with Dx=4, and, in the sub scanning direction, Ty'=25 provides a largest LCM of 150 with Dy=6, thus providing Tx=25 and Ty=25. Also the dither B illustrated in FIG. 3B provides Dx=10 and Dy=10, thus giving LCMs as illustrated in FIG. 6B. For the main scanning direction, Tx'=23 provides a largest LCM of 230 with Dx=10, and, in the sub scanning direction, Ty'=23 provides a largest LCM of 230 with Dy=10, thus providing Tx=23 and Ty=23.

Figure 7:
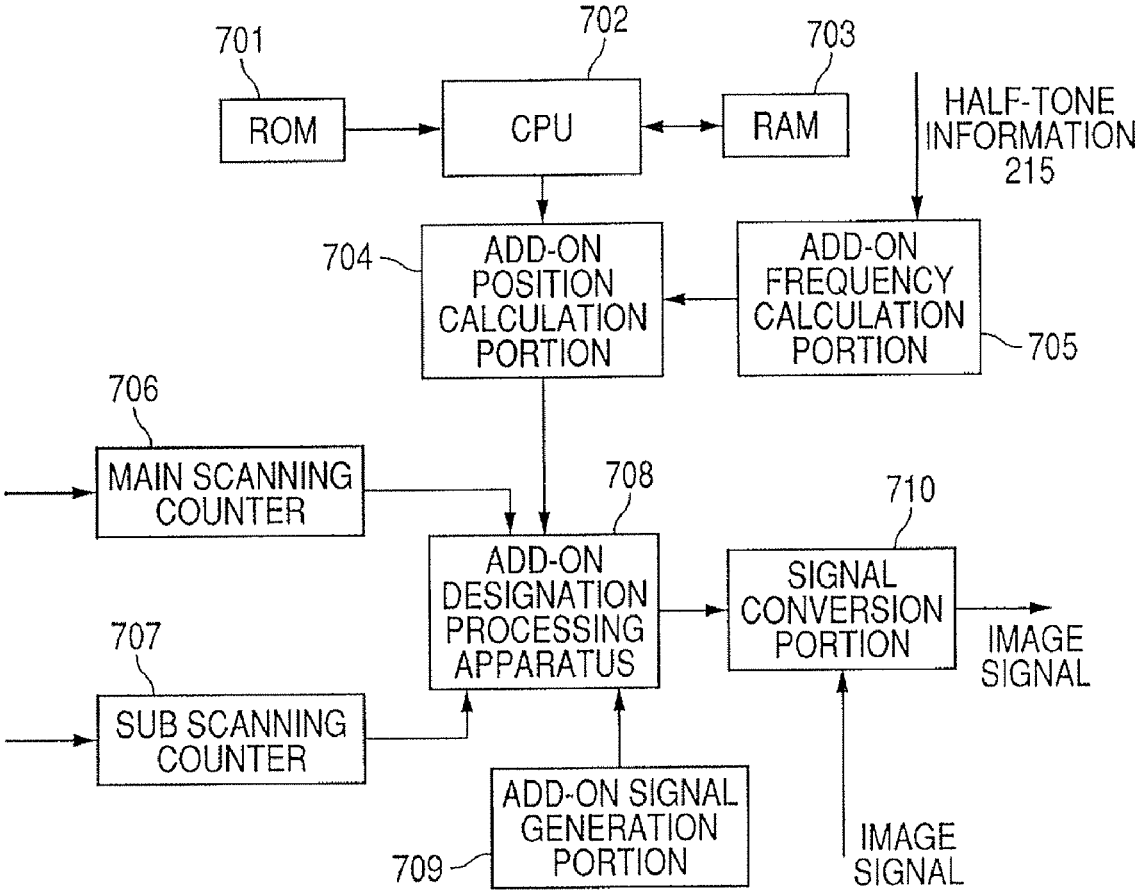
FIG. 7 is a block diagram illustrating the structure of an information add-on processor in the exemplary embodiment 1.

FIG. 7 is a block diagram of an information add-on processor portion 208.

A ROM 701 stores tracing information, for example an individual ID of the image forming apparatus. A CPU 702 receives the individual ID from the ROM 701 at the image formation, and stores it in a RAM 703. The individual ID data is scrambled, then encrypted, also converted into on/off information of each add-on position, and supplied to an add-on position calculation portion 704. Also the CPU 702 receives a color designation signal 214 from the color conversion processing portion 205, and informs it to an add-on designation processing portion 708.

On the other hand, an add-on frequency processing portion 705 receives the halftone information 215 from the halftone processing portion 207. The halftone information 215 indicates the values of Dx and Dy in the currently selected dither table. The add-on frequency processing portion 705 calculates Tx and Ty as described above, based on the input values of Dx, Dy and the values of Sx, Sy and a stored in advance. The calculated values of Tx and Ty are entered into the add-on position calculation portion 704.

The add-on position calculation portion 704 calculates the position of each add-on position, according to the input values of Tx, Ty. It also establishes the position for adding the add-on signal, according to the input on/off information of each add-on position, and sends the information of the add-on position to an add-on designation processing portion 708.

A main scanning counter 706 executes a counting operation according to a clock signal VCLK in the main scanning direction of the image signal, and informs add-on designation processing portion 708 of the count in the main scanning direction. Also a sub scanning counter 707 executes a counting operation according to a clock signal LCLK in the sub scanning direction, and informs add-on designation processing portion 708 of the count in the sub scanning direction. An add-on signal generation portion 709 transmits an add-on signal to the add-on designation processing portion 708.

The add-on designation processing portion 708 turns on the add-on designation signal, based on the add-on position information input from the add-on position calculation portion 704, when the count reaches a value for attaching the add-on signal, and inputs the add-on signal, generated by the add-on signal generation portion 709 to a signal conversion portion 710. This operation is executed only when the color designation signal 214, informed from the CPU 702, designates yellow color. The signal conversion portion 710 superposes the add-on signal, entered from the add-on designation processing portion 708, to the input image signal, thereby outputting an image signal superposed with the add-on signal.

Figure 8:
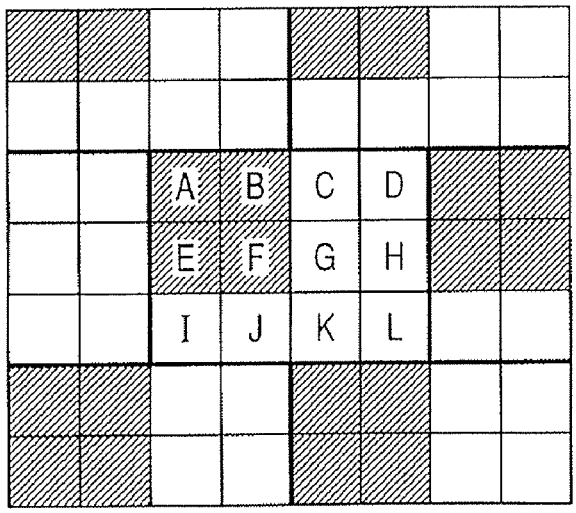
FIG. 8 is a view illustrating a positional relationship between add-on signals and screen dots in the exemplary embodiment 1.

Now there will be described a difference in the add-on pattern of the add-on signal between the conventional example and the present example, taking the dither A as an example. In case of the dither A, the minimum unit of the dither is an area of 4×3 as represented by a thick-lined frame in FIG. 8, and the relative add-on position of the add-on signal relative to the screen dot can be 12 manners as represented therein by A to L. FIGS. 9A, 9B, 9C, 9D, 9E, 9F, 9G, 9H, 9I, 9J, 9K and 9L illustrate states of the add-on signal attached to the screen dots respectively in positional relationships A to L illustrated in FIG. 8. A black area indicates a screen dot, and a hatched area indicates an add-on signal. As will be apparent from FIGS. 9A, 9B, 9C, 9D, 9E, 9F, 9G, 9H, 9I, 9J, 9K and 9L, in case of attaching in the position A or B, the add-on signal overlaps with the screen dot and cannot therefore be detected. On the other hand, in case of attaching in the position G, H, I or J, the screen dots are linked by the add-on signal. As a result, the screen dots are combined to form a larger dot, whereby the add-on signal becomes easily noticeable.

Now there will be described a case of Sx=24, Sy=24 and selection of the dither A. In the conventional example, since Tx=Sx and Ty=Sy, there are obtained Tx=24 and Ty=24. Also in the dither A, Dx=4 and Dy=6, so that Tx and Dx, and Ty and Dy are in mutually multiple relationships. Therefore, the positional relationship remains same between all the add-on signals and the screen dots within the add-on pattern.

Figure 9A:
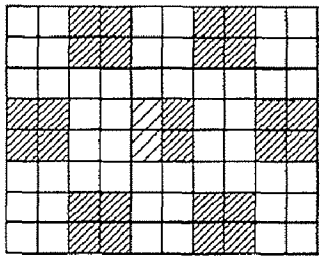
FIGS. 9A, 9B, 9C, 9D, 9E, 9F, 9G, 9H, 9I, 9J, 9K and 9L are views illustrating positional relationships between add-on signals and screen dots in the exemplary embodiment 1.
Figure 9B:
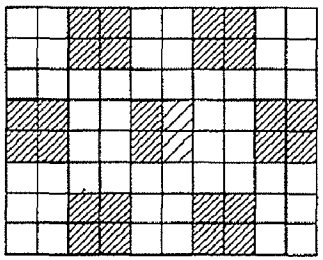
Figure 9C:
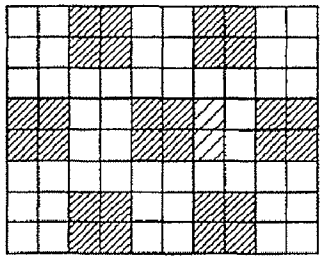
Figure 9D:
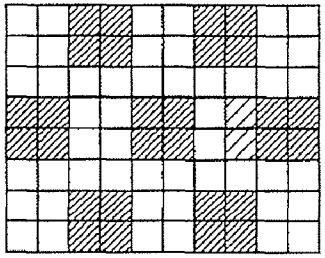
Figure 9E:
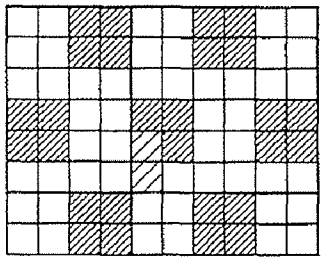
Figure 9F:
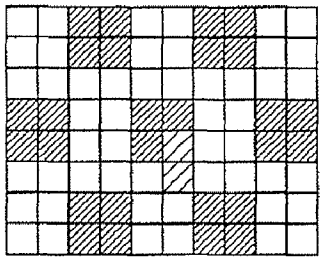

Now, let us consider the positional relationship between the add-on signal and the screen dot in each of add-on positions of (0, 0) to (4, 4) in FIG. 4. In the case, as illustrated in FIG. 10A, that the add-on signal of a position (0, 0) is attached with the positional relationship in FIG. 9A, the add-on signal is attached with the positional relationship A in all the add-on positions, so that detection becomes impossible in all the add-on signals. On the other hand, in the case, as illustrated in FIG. 10B, that the add-on signal of the position (0, 0) is attached with the positional relationship in FIG. 9G, all the add-on signals are attached with the positional relationship G, so that all the add-on signals become easily noticeable, thereby resulting in a deterioration in the image quality.

In contrast, in the present example, Tx=25 provides (Tx mod Dx)=1, so that the positional relationship between the screen dot and the add-on signal, in the add-on positions adjacent in the main scanning direction, is shifted by one pixel in the main scanning direction. Similarly, Ty=25 provides (Ty mod Dy)=1, so that the positional relationship between the screen dot and the add-on signal, in the add-on positions adjacent in the sub scanning direction, is shifted by one pixel in the sub scanning direction.

Figure 11A:
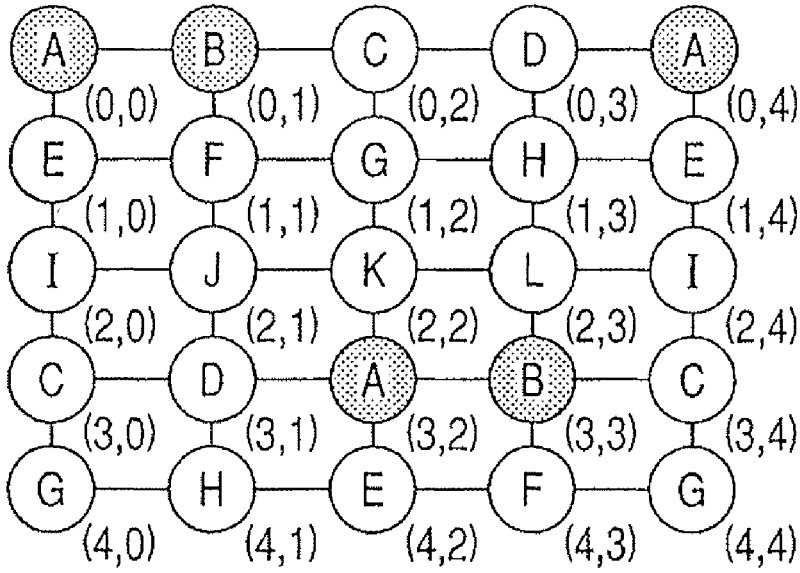
FIGS. 11A and 11B are views illustrating positional relationships between add-on signals and screen dots in the exemplary embodiment 1.

Also let us consider the positional relationship between the add-on signal and the screen dot in each of add-on positions of (0, 0) to (4, 4) in FIG. 4. In the case, as illustrated in FIG. 11A, that the add-on signal of a position (0, 0) is attached with the positional relationship in FIG. 9A, the add-on signal in the position (0, 1) is shifted in the positional relationship with the screen dot by one pixel in the main scanning direction and is attached in a positional relationship B. A next add-on signal at (0, 2) is shifted in the positional relationship with the screen dot by a further one pixel from the positional relationship of (0, 1) and is attached in a positional relationship C. A next add-on signal at (0, 3) is shifted by a further one pixel from the positional relationship of (0, 2) and is attached in a positional relationship D. A next add-on signal at (0, 4) is shifted by a further one pixel from the positional relationship of (0, 3) and returns to the positional relationship A the same as in (0, 0).

Also an add-on signal at (1, 0) is shifted in the positional relationship with the screen dot by one pixel in the sub scanning direction and is attached in a positional relationship E. A next add-on signal at (2, 0) is shifted by a further one pixel from the positional relationship of (1, 0) and is attached in a positional relationship I. A next add-on signal at (3, 0) is shifted by a further one pixel from the positional relationship of (2, 0) to a positional relationship same as C and is therefore attached with the positional relationship C. Positional relationships are also similarly determined for other add-on positions, thus providing a positional relationship illustrated in FIG. 11A.

As a result, the add-on signals in the positional relationship A or B in which the add-on signal overlaps with the screen dot and cannot be discriminated, are in 5 positions among the 25 add-on positions, so that the undetectable add-on signals can be suppressed to 20% of all the signals.

Figure 9G:
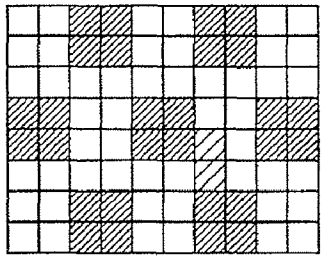
Figure 9H:
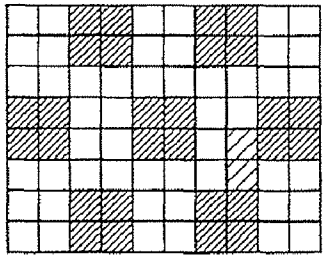
Figure 9I:
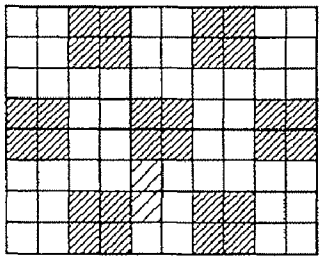
Figure 9J:
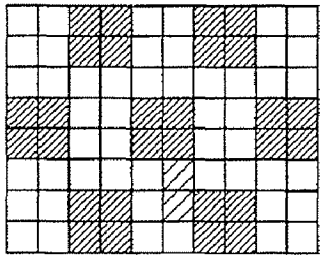
Figure 9K:
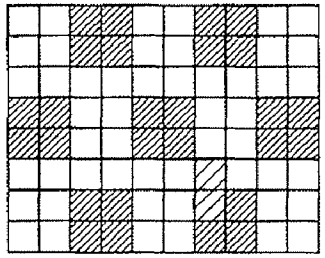
Figure 9L:
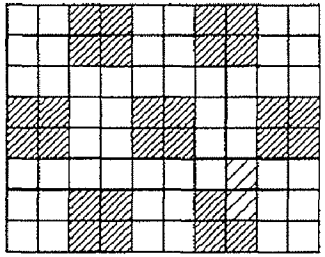
Figure 10A:
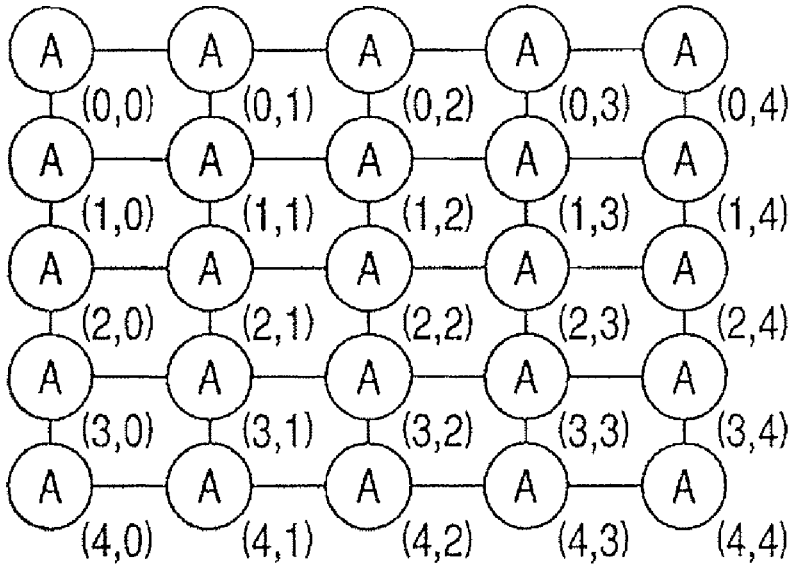
FIGS. 10A and 10B are views illustrating positional relationships between add-on signals and screen dots in a conventional example.
Figure 10B:
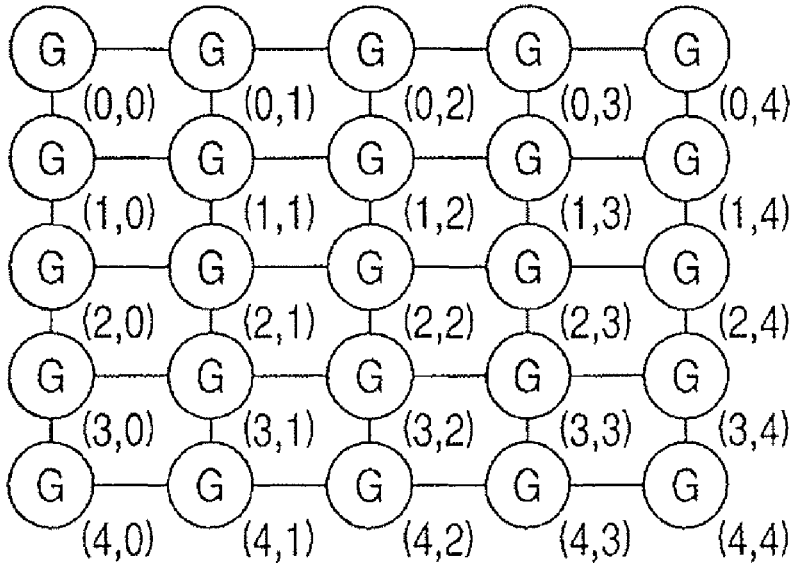
Figure 11B:
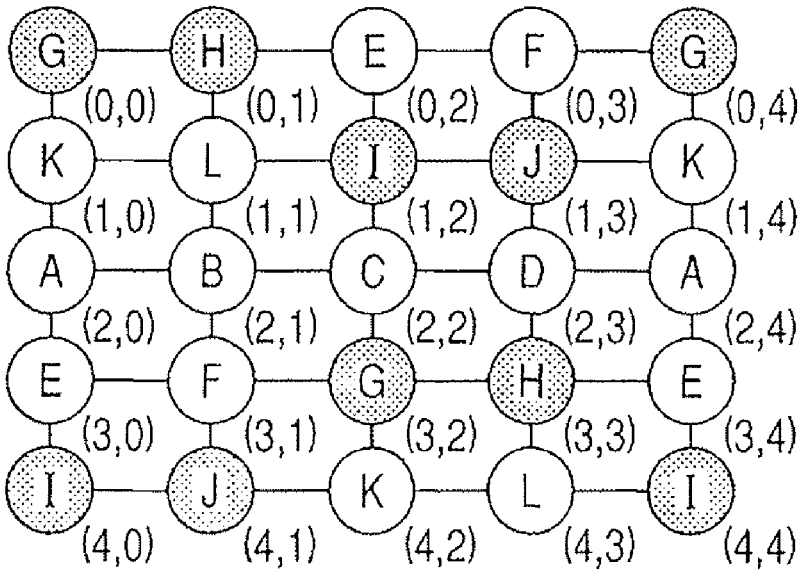

Also in the case that the add-on signal at the position (0, 0) is attached with the positional relationship in FIG. 9G, the positional relationships in all the add-on positions become as illustrated in FIG. 11B, because of the shifts in the positional relationship as described above. As a result, the add-on signals in the easily noticeable positional relationships G, H, I and J become 10 among the 25 add-on positions, so that the easily noticeable add-on signals can be suppressed to 40% of all.

As described above, in any positional relationship between the screen dot and the add-on signal at the add-on position (0, 0), each of the add-on signals that overlap with the screen dots and cannot be discriminated and the easily noticeable add-on signals is suppressed to a certain ratio or less. As a result, the detecting precision of the add-on signal is improved and the image quality can be prevented from deterioration.

In the foregoing, the case of the dither A has been described, but the dither B also provides similar results.

The process of the present example can be executed with the above-described construction. The present example assumes $\alpha=2$, but the value of $\alpha$ may be determined within a range not affecting the detection. Also the present invention assumes the margin $\alpha$ same for the main and sub scanning directions, but different values may be selected respectively in the main and sub scanning directions. Also the size of the add-on pattern, the type of dither tables and the minimum rectangular size of the dither are not restricted to those described above.

EXAMPLE 2

Now a color image forming apparatus of Example 2 will be described. In the present example, the structures of the color image forming apparatus, the signal processing, the add-on pattern and the information add-on processing portion are similar to those in Example 1. In the present example, description will be made only on points different from Example 1, and constructions similar to those in Examples 1 will be represented by similar symbols and will not be described repeatedly.

Figure 12:
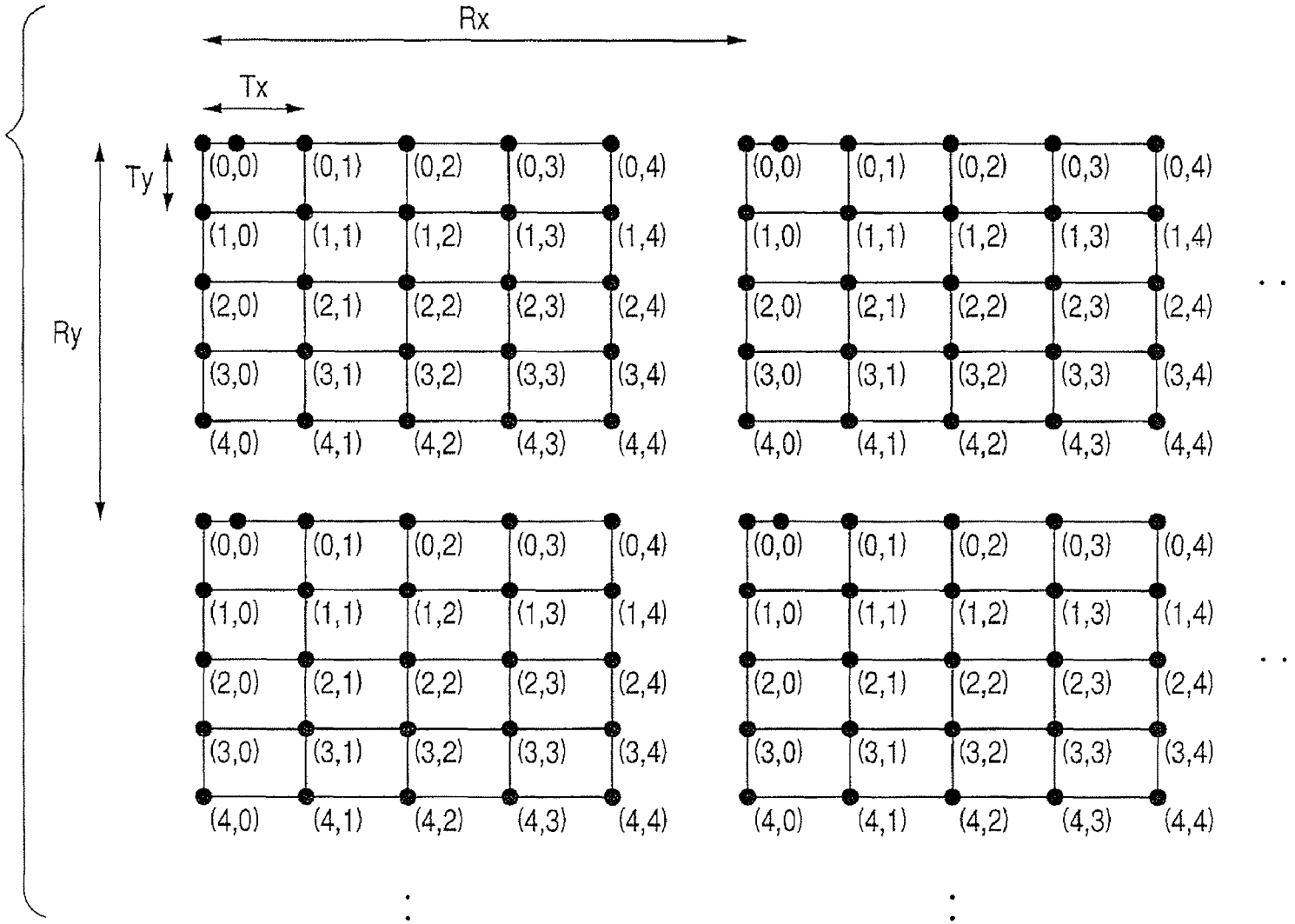
FIG. 12 is a view illustrating arrangement of add-on pattern in an exemplary embodiment 2.

In the present example, as illustrated in FIG. 12, an add-on pattern to be attached repeatedly in the main and sub scanning directions over the entire image has repeating periods of Rx, Ry respectively in the main and sub scanning directions.

As in Example 1, the add-on periods Tx, Ty have predetermined reference values which are respectively indicated by Sx, Sy. Also the add-on periods have a predetermined tolerable (range) margin $\pm\alpha$ with respect to the reference values. Therefore Tx and Ty respectively have tolerable ranges from $Sx-\alpha$ to $Sx+\alpha$, and from $Sy-\alpha$ to $Sy+\alpha$.

In the present example, in the dither table selected by the halftone process portion 207, LCMs are calculated for the values of Dx, Dy and $Tx'=Sx-\alpha$ to $Sx+\alpha$, and $Ty'=Sy-\alpha$ to $Sy+\alpha$, and Tx' and Ty' giving minimum LCMs are respectively represented by Tx and Ty.

As a specific example, the calculation according to the dither A illustrated in FIG. 3A for Sx=24, Sy=24 and $\alpha=2$ provides Dx=4 and Dy=6, thus giving least common multiples (LCMs) as illustrated in FIG. 13A, among which a smallest LCM is selected. For the main scanning direction, Tx'=24 provides a smallest LCM of 24 with Dx=4, and, in the sub scanning direction, Ty'=24 provides a smallest LCM of 24 with Dy=6, thus providing Tx=24 and Ty=24. Also the dither B illustrated in FIG. 3B provides Dx=10 and Dy=10, thus giving LCMs as illustrated in FIG. 13B. For the main scanning direction, Tx'=25 provides a smallest LCM of 50 with Dx=10, and, in the sub scanning direction, Ty'=25 provides a smallest LCM of 50 with Dy=10, thus providing Tx=25 and Ty=25.

Also the periods Rx, Ry of the add-on pattern have predetermined reference values which are respectively indicated by Px, Py. Also the periods of the add-on pattern have a predetermined tolerable (range) margin $\pm\beta$ with respect to the reference values. Therefore Rx and Ry respectively have tolerable ranges from $Px-\beta$ to $Px+\beta$, and from $Py-\beta$ to $Py+\beta$.

In the present example, in the dither table selected by the halftone process portion 207, LCMs are calculated for the values of Dx, Dy and $Rx'=Px-\beta$ to $Px+\beta$, and $Ry'=Py-\beta$ to $Py+\beta$, and Rx' and Ry' giving maximum LCMs are respectively represented by Rx and Ry.

As a specific example, the calculation according to the dither A illustrated in FIG. 3A for Px=124, Py=124 and $\beta=2$ provides Dx=4 and Dy=6, thus giving least common multiples as illustrated in FIG. 14A, among which a largest LCM is selected. For the main scanning direction, Rx'=125 provides a largest LCM of 500 with Dx=4, and, in the sub scanning direction, Ry'=125 provides a largest LCM of 750 with Dy=6, thus providing Rx=125 and Ry=125. Also the dither B illustrated in FIG. 3B provides Dx=10 and Dy=10, thus giving LCMs as illustrated in FIG. 14B. For the main scanning direction, Rx'=123 provides a largest LCM of 1230 with Dx=10, and, in the sub scanning direction, Ry'=123 provides a largest LCM of 1230 with Dy=10, thus providing Rx=123 and Ry=123.

In the present example, the add-on period calculation portion 705 receives, as in Example 1, from the halftone processing portion 207, the halftone information 215, namely the values of Dx, Dy for the currently selected dither table. The add-on period calculation portion 705 calculates Tx, Ty, Rx and Ry based on the input Dx, Dy values and the values of Sx, Sy, $\alpha$, Px, Py and $\beta$ stored in advance. The calculated values of Tx, Ty, Rx and Ry are input into the add-on position calculation portion 704. Other operations are same as in Example 1.

Now there will be described a difference in the add-on pattern of the add-on signal between the conventional example and the present example, taking the dither A as an example. Now there will be described a case of Sx=24, Sy=24, Px=124 and Py=124 and selection of the dither A. In the conventional example, since Tx=Sx, Ty=Sy, Rx=Px and Ry=Py, there are obtained Tx=24, Ty=24, Rx=124 and Ry=124. Also in the dither A, Dx=4 and Dy=6, so that Tx and Dx, and Ty and Dy are in mutually multiple relationships, and Rx and Dx, and Ry and Dy are in mutually multiple relationships. Therefore, the positional relationship remains same between all the add-on signals and the screen dots within the add-on pattern, and all the add-on patterns repeated within the image remain same in the positional relationship between the add-on signals and the screen dots.

Thus, the positional relationship between the add-on signal and the screen dot remains same in the entire image. In the case that the add-on signal of a position (0, 0), in the initial add-on pattern, is attached with the positional relationship in FIG. 9A, the add-on signal is attached with the positional relationship A in all the add-on positions, so that detection becomes impossible in all the add-on signals. On the other hand, in the case that the add-on signal of the position (0, 0), in the initial add-on pattern, is attached with the positional relationship in FIG. 9G, all the add-on signals are attached with the positional relationship G, so that all the add-on signals become easily noticeable, thereby resulting in a deterioration in the image quality.

On the other hand, in the present example, since Tx=24 and Ty=24, all the add-on signals and the screen dots have a same positional relationship within the add-on pattern, as in the conventional example. However, Rx=125 provides (Rx mod Dx)=1, so that the positional relationship between the screen dot and the add-on signal, in the add-on pattern which is adjacent in the main scanning direction, is shifted by one pixel in the main scanning direction. Similarly, Ry=125 provides (Ry mod Dy)=1, so that the positional relationship between the screen dot and the add-on signal, in the add-on pattern which is adjacent in the sub scanning direction, is shifted by one pixel in the sub scanning direction.

Thus, in the case that the add-on signal of a position (0, 0), in the initial add-on pattern, is attached with the positional relationship in FIG. 9A, all the positional relationships between all the add-on signals and the screen dots become A in the initial add-on pattern. In the add-on pattern adjacent in the main scanning direction, the positional relationship is shifted by one pixel in the main scanning direction, so that all the positional relationships between the add-on signals and the screen dots become B. Similarly, the positional relationship in the add-on patterns is shifted by one pixel in succession, the positional relationship between the add-on signals and the screen dots becomes C and D in succession, and A again in an add-on pattern next to that of relationship D. In the add-on pattern adjacent in the sub scanning direction, the positional relationship is shifted by one pixel in the sub scanning direction, so that all the positional relationships between the add-on signals and the screen dots become E. Similarly, the positional relationship in the add-on patterns is shifted by one pixel in succession, the positional relationship between the add-on signals and the screen dots becomes I, and C again in an add-on pattern next to that of relationship I.

As a result, as illustrated in FIG. 15A, in the 5×4 add-on pattern areas within an image, the areas A and B in which the add-on signal cannot be detected, are in 5 areas among the 20 add-on areas, thus being limited to 25% of the entire image. Therefore, the add-on signal can be detected in 75% of the entire image, thus improving the detection accuracy of the add-on signal.

Also in the case that the add-on signal at the position (0, 0) in the initial add-on pattern is attached with the positional relationship in FIG. 9G, the positional relationships between the add-on signals and the screen dots become G in the initial add-on pattern. As the positional relationship is shifted by one pixel each for each adjacent add-on pattern, the positional relationships in the add-on patterns become as illustrated in FIG. 15B.

As a result, as illustrated in FIG. 15B, within 5×4 add-on pattern areas in the image, the areas of the easily noticeable positional relationships G, H, I and J become 7, thus being suppressed to 35% of the entire image. Therefore, the add-on signal is less noticeable in 65% of the entire image, thus suppressing the deterioration in quality of the entire image.

In the foregoing, the case of the dither A has been described, but the dither B also provides similar results.

The process of the present example can be executed by the above-described construction. In the present example the positional relationship within the add-on pattern is fixed, but the present invention can be executed effectively even without fixing the positional relationship within the add-on pattern.

OTHER EXAMPLES

The present invention may be realized in various forms such as an apparatus, a method, a program or a storage medium. More specifically, it may be applied to a system including plural equipment (such as a host computer, an interface equipment, a reader, a printer and the like) or to an apparatus formed by a single equipment (such as a copying apparatus or a facsimile apparatus).

The objects of the present invention can also be accomplished by a following construction. The objects of the present invention can naturally be accomplished also by supplying a system or an apparatus with a storage medium storing program codes of a software realizing the functions of the aforementioned examples, and by reading and executing the program codes stored in the storage medium, by a computer (or CPU or MPU) of the system or the apparatus.

In such case, the program codes themselves read out from the storage medium realize the functions of the aforementioned examples, and the storage medium storing such program codes constitutes the present invention.

Also the functions of the aforementioned examples can be accomplished not only in a case where the computer reads and executes the program codes, but also in case where an operating system (OS) or the like functioning on the computer executes all the actual processes or a part thereof thereby realizing the functions of the aforementioned examples.

The present invention further includes a case where the program codes, read out from the storage medium, are written into a memory provided in a function expansion card inserted into the computer or a function expansion unit connected to the computer, and a CPU or the like provided in the function expansion card or the function expansion unit executes, according to the instruction of such program codes, all the actual processes or a part thereof thereby realizing the functions of the aforementioned examples.

In the examples described above, the positional relationship between the add-on signal and the screen dot does not become constant and the add-on signals detectable within a predetermined area are present with a certain proportion or higher, whereby the precision of detection can be improved. Also the easily noticeable add-on signals are present with a certain property or lower, so that the deterioration in the image quality can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This applications claims the benefit of Japanese Patent Application No. 2006-131222 filed May 10, 2006, which is hereby incorporated by reference herein in its entirety.

What is claimed is:

1. An image forming apparatus comprising:

a halftone processor that performs a halftone process on an input image signal using a predetermined halftone processing period;

an add-on processor that adds an add-on signal into the image signal on which the halftone process is performed, in a selected period; and an image forming unit which forms an image on a recording medium, based on an output of the add-on processor, wherein among period values in a range defined by a predetermined reference and tolerable values, the selected period corresponds to a period value that causes a maximum least common multiple among least common multiples obtained between a value of the predetermined halftone processing period and the period values in the range defined by the predetermined reference and the tolerable values.

2. An image forming apparatus according to claim 1, wherein the halftone processing period is a length of a minimum repeating rectangle in main and sub scanning directions in the halftone process.

3. An image forming apparatus according to claim 1, wherein the predetermined halftone processing period is chosen from plural halftone processing periods; and wherein the selected period is determined based on the chosen predetermined halftone processing period.

4. An image forming apparatus according to claim 1, wherein the add-on signal is repeatedly added to the image signal based on an add-on pattern that regulates a minimum interval between add-on positions and indicates the add-on positions of the add-on signal.

5. An image forming apparatus according to claim 4, wherein the selected period is a minimum distance between the add-on positions within the add-on pattern.

6. An image forming apparatus according to claim 4, wherein the add-on pattern is added in repetition to the image signal, and the selected period is a distance between the add-on patterns.

7. A control method for an image forming apparatus, comprising:

performing a halftone process on an input image signal using a predetermined halftone processing period;

adding an add-on signal into the image signal on which the halftone process is performed, in a selected period; and forming an image on a recording medium, based on the image signal to which the add-on signal is added, wherein among period values in a range defined by a predetermined reference and tolerable values, the selected period corresponds to a period value that causes a maximum least common multiple among least common multiples obtained between a value of the predetermined halftone processing period and the period values in the range defined by the predetermined reference and the tolerable values.

8. A storage medium storing a control program for controlling an image forming apparatus to form an image on a recording medium, based on an image signal to which an add-on signal is added, the program executing steps of:

performing a halftone process on an input image signal using a predetermined halftone processing period; and adding an add-on signal into the image signal on which the halftone process is performed, in a selected period, wherein among period values in a range defined by a predetermined reference and tolerable values, the selected period corresponds to a period value that causes a maximum least common multiple among least common multiples obtained between a value of the predetermined halftone processing period and the period values in the range defined by the predetermined reference and the tolerable values.

* * * * *